US006830435B2

(12) United States Patent
Goetzfried et al.

(10) Patent No.: US 6,830,435 B2
(45) Date of Patent: Dec. 14, 2004

(54) FASTENING OF THE BLADES OF A COMPRESSION MACHINE

(75) Inventors: Eduard Goetzfried, Allersberg (DE); Helmut Wendler, Henfenfeld (DE); Heinz May, Dietenhofen (DE)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 10/221,217

(22) PCT Filed: Mar. 22, 2001

(86) PCT No.: PCT/IB01/00441

§ 371 (c)(1),
(2), (4) Date: Jan. 8, 2003

(87) PCT Pub. No.: WO01/71165

PCT Pub. Date: Sep. 27, 2001

(65) Prior Publication Data

US 2003/0143077 A1 Jul. 31, 2003

(30) Foreign Application Priority Data

Mar. 23, 2000 (DE) ..... 100 14 189

(51) Int. Cl.[7] ..... F01D 5/22
(52) U.S. Cl. ..... 416/189; 416/193 A; 416/212 A
(58) Field of Search ..... 416/190, 193 A, 416/212 R, 212 A, 248, 189

(56) References Cited

U.S. PATENT DOCUMENTS

| | | | | |
|---|---|---|---|---|
| 2,421,890 A | | 6/1947 | Johansson | 253/57 |
| 2,916,257 A | | 12/1959 | Poellmitz et al. | 253/77 |
| 3,524,712 A | | 8/1970 | Petrie et al. | |
| 3,734,645 A | | 5/1973 | Strub | |
| 5,211,540 A | * | 5/1993 | Evans | 416/190 |
| 5,829,955 A | | 11/1998 | Saito et al. | |
| 6,030,178 A | | 2/2000 | Caruso | |
| 6,341,941 B1 | * | 1/2002 | Namura et al. | 416/190 |

FOREIGN PATENT DOCUMENTS

| | | | | |
|---|---|---|---|---|
| AT | 254227 | | 5/1967 | |
| DE | 1159965 | | 7/1965 | |
| DE | 1426778 | | 11/1969 | F01D/5/30 |
| DE | 10108005 A1 | * | 8/2002 | F01D/5/22 |
| EP | 0520258 | | 12/1992 | F03B/11/04 |
| GB | 2072760 | | 10/1981 | F01D/5/22 |
| WO | WO99/13200 | | 3/1999 | F01D/5/22 |

OTHER PUBLICATIONS

International Search Report for PCT Application No. PCT/IB01/00441, mailed Jun. 1, 2001.

* cited by examiner

*Primary Examiner*—Ninh H. Nguyen
(74) *Attorney, Agent, or Firm*—Cermak & Kenealy LLP; Adam J. Cermak

(57) ABSTRACT

The blades (1, $\mathbf{1_1}$, $\mathbf{1_2}$, $\mathbf{1_3}$, $\mathbf{1_n}$) of a turbine or compressor are fastened into a groove (8) on the rotor (6) or stator of the turbine or compressor by blade roots (4), there being no play or a prestress prevailing between the root plate (3) and/or the blade root (4), and adjacent blades (1, $\mathbf{1_1}$, $\mathbf{1_2}$, $\mathbf{1_3}$, $\mathbf{1_n}$) thereby being supported relative to one another with respect to torsional moments (12) and not or only slightly on the rotor (6) or stator. This is possible, for example, by incorporating a bevel (9).

6 Claims, 2 Drawing Sheets

FASTENING OF THE BLADES OF A COMPRESSION MACHINE

BACKGROUND OF THE INVENTION

1. Field of the Invention

The invention relates to a fastening or anchoring of blades of a turbomachine by means of blade roots to the rotor or stator of the turbomachine.

2. Discussion of Background

Blade fastenings of this type are found, as a rule, on rotors of compressors or thermal turbomachines. They are known in large numbers from the prior art.

The blades are introduced with the blade root into a groove which is located on the rotor. The blade root serves in this case for the transmission of force and torque to the rotor.

For vibration damping, cover plates (shroud elements) are often attached to the tip of the blade or supporting wings within the blade.

This is described, for example, in German patent specification DE 1,159,965.

Austrian patent specification AT 254,227 also discloses a cover plate of a turbine or compressor blade ring, in which the cover plates are pressed against one another by the action of force. The arrangement leads to an elastic prestressing of the blade. This torsional prestress of the blade takes place between the cover plate and the blade root, but leads to additional load on the blade root and on the rotor. Since the forces which occur not only have to be absorbed by the blade, but also by the blade root and by the rotor, these have a correspondingly massive construction.

Spacers are often arranged between the individual blade roots of the turbine blades, which spacers are intended to absorb the forces and also serve for vibration damping. This is known, for example, from the patents U.S. Pat. No. 2,916,257 or else U.S. Pat. No. 3,734,645. Another moving-blade fastening is also known from European preliminary publication EP-A1-520,258. For the limitation of circumferential forces as a result of thermal expansions, longitudinal webs are provided between the moving blades.

Such prior art has the disadvantage, however, that the load is transmitted basically via the blade root to the rotor. This applies particularly to the abovementioned torsional moments. However, the relatively massive construction of the rotor and blade roots has adverse effects particularly on the width of the blade and blade root and of the wheel disk and consequently also on the entire length of the rotor. As a result of the higher root load, more cost-effective root designs (for example, hammerhead root, rider blade root) had to be dispensed with and, instead, there had to be recourse to more stable and more costly root forms (such as, for example, the insertion root).

SUMMARY OF THE INVENTION

The aim of the invention is to avoid the disadvantages mentioned. Accordingly, one object of the invention is to provide a novel fastening for blades of a turbomachine to a rotor or stator, by means of which fastening the torsional moments can be absorbed to an increased extent by the blade root or the root plate of the blade, while at the same time the rotor/stator and the blade root are relieved. Moreover, the overall length of the rotor/stator is to be shortened or, for the same length, the number of blade rows is to be increased and/or the use of cost-effective root connections is to be made possible.

According to the invention, after the installation of all the blades, the blades are contiguous to one another on the rotor or stator at the root plate and/or at the blade root completely or partially without play or with a prestress and arc therefore supported relative to one another with respect to torsional moments, the torsional moments which act at the root plates and/or at the blade roots being opposite to the torsional moments which act at the cover plate or at the supporting wing.

This embodiment has the advantage that torsional moments are no longer or only marginally absorbed by the rotor, but, instead, by the root plates and/or blade roots contiguous to one another, since a twisting of these two structural elements is prevented. By virtue of this measure, the blade root and also the rotor (or stator) can have a correspondingly smaller dimensioning, since relatively high forces no longer have to be absorbed at the rotor (stator)/blade-root contact face. Overall, therefore, the length of the rotor can be reduced. With the length of the rotor (stator) being the same, the number of blade rows and consequently also the efficiency can be increased.

Moreover, it is possible to use other root connections which could not be used with the previous technique. For example, a single-prong insertion root, a hammerhead root or an equivalent simple blade root can advantageously be employed. Such blade roots can be manufactured in a simple way and without great difficulty by means of known milling methods.

The root plate and possibly also the blade root have a bevel which is advantageously contiguous to a bevel of an adjacent moving blade, and therefore torsional moments are absorbed mutually at this point.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for the invention are illustrated. Identical elements are given the same reference symbols in the various figures.

DESCRIPTION OF THE PREFERRED EMBODIMENTS

Figure 1:
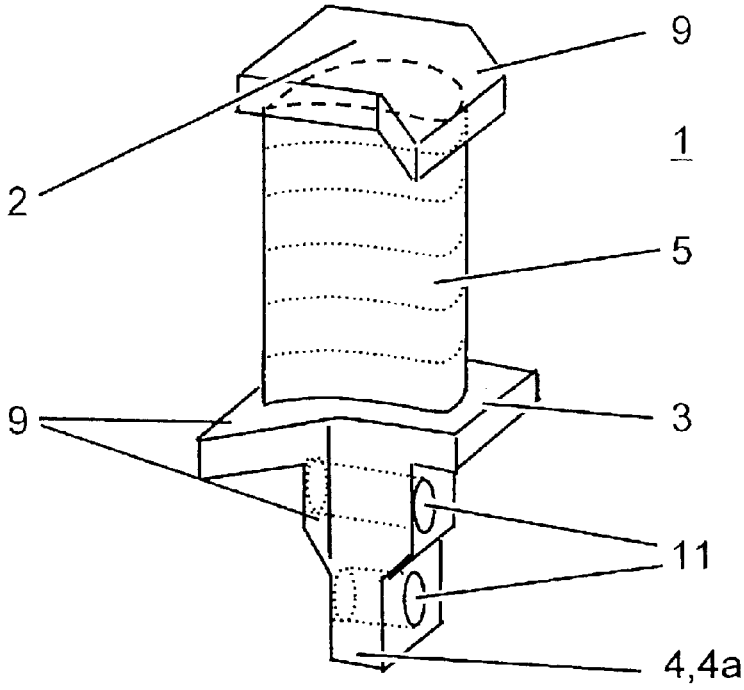
FIG. 1 shows a turbine blade of a steam turbine with a single-prong blade root and cover plate/supporting wing.
Figure 3:
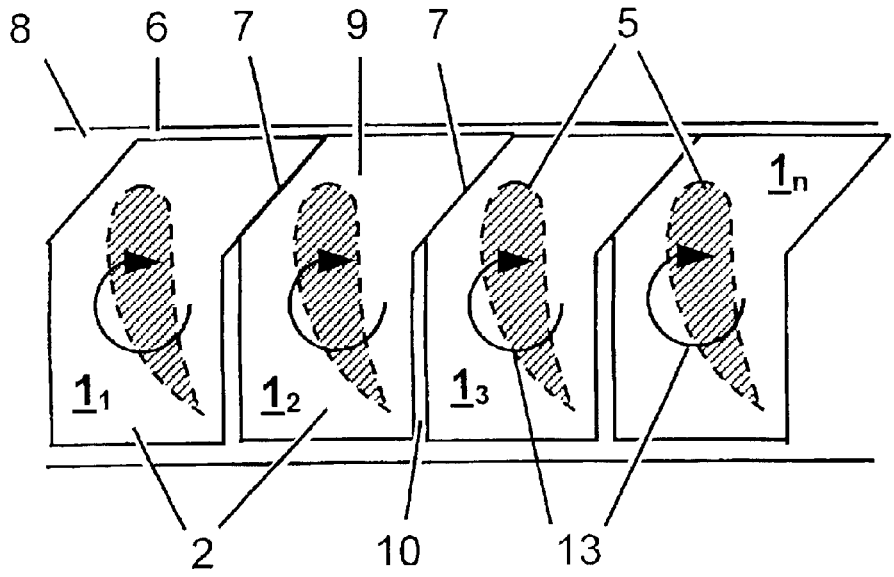
FIG. 3 shows a top view of an exemplary embodiment according to the invention with the cover plates of the turbine blades.

Referrring now to the drawings, wherein like reference numerals designate identical or corresponding parts throughout the several views, FIG. 1 shows a blade 1 of a turbomachine, that is to say, for example, of a steam turbine or of a compressor. The blade 1, which may be a moving blade or a guide vane, consists of a blade root 4, of a root plate 3 adjoining the blade root 4, of a cover plate 2 or supporting wing or supporting plate and of a blade 5 located between the root plate 3 and the cover plate 2. The blade root 4 is designed, in FIG. 1, as a single-prong insertion root 4*a*. It serves for fastening the blade 1 to the rotor 6, not illustrated in FIG. 1, or to a stator. Both the root plate 3 and the cover plate 2 of the blade 1 are equipped with a bevel 9. The bevel 9 is located on the one side of the cover plate 2 or root plate 3, that is to say the bevel 9 is to be understood as being on both plates 2, 3 in terms of a top view, as also becomes clear in FIGS. 3 and 4. It is also possible for a bevel 9 likewise to be formed on the blade root 4. The blade 1 may also be a blade with a multi-prong insertion root.

Figure 2:
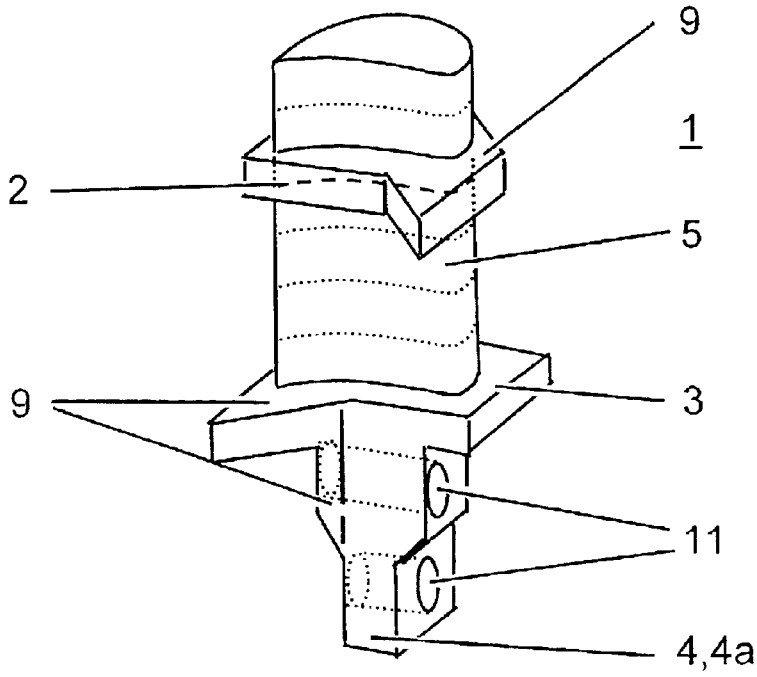
FIG. 2 shows a turbine blade of a steam turbine with a supporting plate (supporting wing) within the blade.

As is evident from FIG. 2, the cover plate 2 can be mounted on the blade 5 between the blade tip 14 and the root plate 3. This applies in general to all blade types capable of being used.

In the blades, which are shown in FIG. 1 and in FIG. 2, there are additionally in the blade root 4, 4*a* holes 11 which serve for fastening the root to the rotor or stator by means of bolts.

When the blades $\mathbf{1}_1$, $\mathbf{1}_2$, $\mathbf{1}_3$, $\mathbf{1}_n$ are being installed in a groove 8 on the rotor 6 or else on a stator, torsional moments 13 acting in the direction of the bevel 9 are applied at the cover plate 2. The contact point 7 at which the torsional moments 13 are absorbed occurs in this case. This is illustrated in the blade row of FIG. 3 which shows a top view of the various blades $\mathbf{1}_1$, $\mathbf{1}_2$, $\mathbf{1}_3$, $\mathbf{1}_n$. The blades $\mathbf{1}_1$, $\mathbf{1}_2$, $\mathbf{1}_3$, $\mathbf{1}_n$ in thereby acquire some prestress. A gap 10 is thus formed between the other part of the cover plate 2 at which the cover plates 2 are not contiguous to one another. The blade leaves 5, which may be arranged below the cover plate 2, can also be seen in FIG. 3. In the case of an intermediate arrangement of the cover plate 2 on the blade 5, as illustrated in FIG. 2, this is above and below the cover plate 2.

Figure 4:
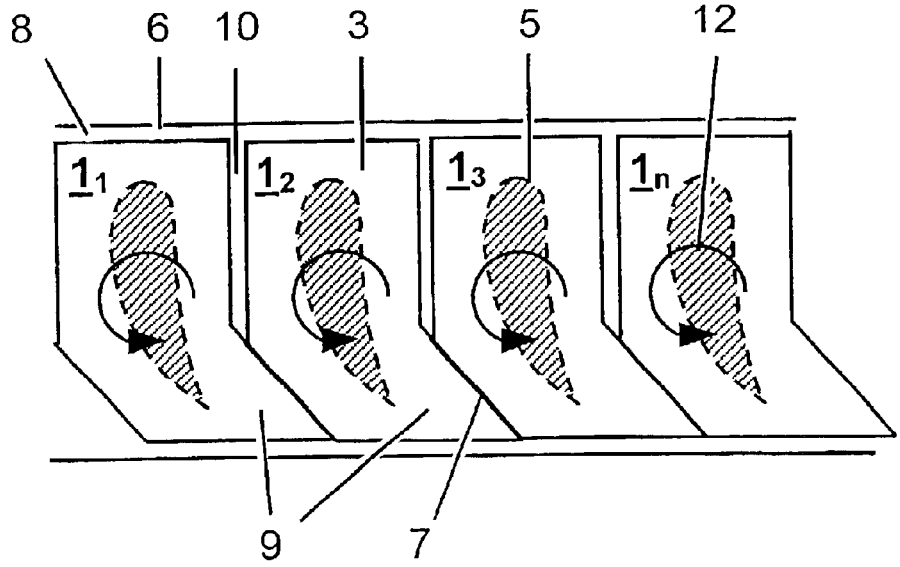
FIG. 4 shows a section through an exemplary embodiment according to the invention of turbine blades which are arranged in a groove on the rotor or stator of the turbomachine, the root plates being visible.

FIG. 4 shows a section through a blade row, the root plates 3 of the blades $\mathbf{1}_1$, $\mathbf{1}_2$, $\mathbf{1}_3$, $\mathbf{1}_n$ being visible in this figure.

Once again, adjacent root plates 3 abutt directly, free of play, against one another at the contact points 7. The contact points 7 between adjacent plates 3 are in the region of the bevels 9. A gap 10 is formed in the other part of the root plates 3. The torsional moments 12 acting on the root plates 3 are, however, opposite to the torsional moments 13 shown in FIG. 3, so that the bevels 9 are also arranged at another corresponding end of the respective plate 2, 3. According to the invention, it is also possible to provide a prestress between the individual root plates 3. The contact point 7 may also relate, overall, to the contiguous root plates 3, without a gap 10 being formed. As already illustrated in FIG. 1, the bevels 9 may also relate to regions of the blade root 4. However, this is not shown in any more detail in FIG. 4.

Since adjacent moving blades $\mathbf{1}_1$, $\mathbf{1}_2$, $\mathbf{1}_3$, $\mathbf{1}_n$ are contiguous to one another at the bevel 9 and the torsional moment 12 acts in this direction, the moving blades are supported relative to one another. Twisting no longer takes place or takes place only to a very slight extent, so that the force has to be absorbed by the moving blades $\mathbf{1}_1$, $\mathbf{1}_2$, $\mathbf{1}_3$, $\mathbf{1}_n$ themselves and no longer by the rotor 6 (or the stator) or by the groove 8. The load on the rotor 6 is advantageously reduced by means of this type of arrangement of the moving blades $\mathbf{1}_1$, $\mathbf{1}_2$, $\mathbf{1}_3$, $\mathbf{1}_n$. This takes place primarily as a result of the play-free or prestressed mounting at the root plates 3 and/or at the blade roots 4. The bevel 9 must then, of course, also be present on the blade root 4, in order to take account of the existing effect.

The single-prong insertion root illustrated in FIG. 1 is, however, selected only as an example. Various types known per se from the prior art, such as, for example, a hammer root or rider root, may be used as a blade root 4.

It is particularly noteworthy, however, that even blade roots 4 which have hitherto been incapable of being used or been capable of being used only under difficult conditions can be employed. This is possible due to the reduced transmission of force from the blade root 4 to the rotor 6 or to the stator. Since the blade roots 4 and also the rotor 6 or the stator can have smaller dimensioning (for example, in width), the overall length of the rotor 6 can be reduced or, for the same length of the rotor 6 (stator), the efficiency of the turbomachine can be increased by means of additional blade rows. Existing rotors 6 (stators) can also easily be converted to the new type of fastening of the moving blades 1. This is an advantage, since simpler blades 1 which can be manufactured more cost-effectively can now be used. For example, the insertion root shown in FIG. 1 or else a hammer root can be produced in a simple way by means of known milling methods.

Obviously, numerous modifications and variations of the present invention are possible in light of the above teachings. It is therefore to be understood that within the scope of the appended claims, the invention may be practiced otherwise than as specifically described herein.

List of Designations

1, $\mathbf{1}_1$, $\mathbf{1}_2$, $\mathbf{1}_3$, $\mathbf{1}_n$ guide or moving blade
2 cover plate
3 root plate
4 blade root
4*a* single-prong blade root
5 blade
6 rotor
7 contact point
8 groove
9 bevel
10 gap
11 hole
12 torsional moment at root plate 3
13 torsional moment at root plate 2
13 turbine blade tip

What is claimed as new and desired to be secured by letters patent of the United States is:

1. A system for fastening blades of a turbomachine to a rotor or stator, comprising:

an element selected from the group consisting of a rotor and a stator;

a plurality of blades, the blades each having a root, a root plate, a cover plate or a supporting wing above the blade root, and a blade leaf, each blade being installed on the element with a blade root, and a torsional moment acting on the cover plate or on the supporting wing as a result of the installation of the blades on the element;

wherein the blades are contiguous to one another on the element at the root plate, at the blade root, or both with a prestress and are supported relative to one another with respect to torsional moments, the torsional moments which act at the root plates, at the blade roots, or both being opposite to the torsional moments which act at the cover plate or at the supporting wing.

2. The system for fastening blades as claimed in claim 1, wherein both the root plate, the blade root, or both, and the cover plate or the supporting wing have a bevel which is arranged at the point at which the applied torsional moments act and at which the blades are supported relative to one another.

3. The system for fastening blades as claimed in claim 1, wherein each cover plate or supporting wing is arranged on a blade leaf between the root plate and the blade tip.

4. The system for fastening blades as claimed in claim 1, wherein each blade root comprises a root selected from the group consisting of a single-prong, a multi-prong insertion root, and a hammerhead root.

5. The system for fastening blades as claimed in claim 4, wherein each blade root comprises holes through which the blade root can be fastened to the element by bolts.

6. The system for fastening blades as claimed in claim 4, wherein each of the blades are guide vanes or moving blades of a turbine or compressor.

* * * * *